US005146878A

United States Patent [19]

Hulkkonen

[11] Patent Number: 5,146,878

[45] Date of Patent: Sep. 15, 1992

[54] BOILER AND A SUPPORTED HEAT TRANSFER BANK

[75] Inventor: Tuomo Hulkkonen, Varkaus, Finland

[73] Assignee: A. Ahlstrom Corporation, Noormarkku, Finland

[21] Appl. No.: 800,518

[22] Filed: Dec. 3, 1991

[30] Foreign Application Priority Data

Dec. 21, 1990 [FI] Finland ..... 906348

[51] Int. Cl.[5] ..... F22B 37/24

[52] U.S. Cl. ..... 122/510; 122/511; 122/512; 165/162; 165/910; 248/49

[58] Field of Search ..... 122/510, 511, 512, 235.23; 165/162, 178, DIG. 910; 248/49

[56] References Cited

U.S. PATENT DOCUMENTS 3,414,052 12/1968 Chojnowski et al. ..... 122/510 X 4,961,402 10/1990 Delsol ..... 122/512 X

*Primary Examiner*—Edward G. Favors

*Attorney, Agent, or Firm*—Nixon & Vanderhye

[57] ABSTRACT

In a boiler, particularly a recirculating fluidized bed boiler, the tubes of heat exchanger banks (panels) are connected together so that they are securely supported against sideways movement. A first heat transfer panel has a first plurality of elongated heat transfer tubes, vertically stacked one atop the other, and extending horizontally in a first dimension; and a second heat transfer panel has a second plurality of vertically stacked heat transfer tubes extending horizontally in a second dimension, perpendicular to the first dimension. The panels are supported by walls of the boiler reaction chamber. Connectors attach one of the tubes of the second bank to the first bank to stiffen the first bank against sideways movement. The connectors may be bollard or triangularly shaped lugs welded to or operatively engaging tubes of both banks, or a tube of the first bank may be bent to form a loop, with a tube of the second bank passing through the loop and engaging the bends of the bent tube.

20 Claims, 5 Drawing Sheets

BOILER AND A SUPPORTED HEAT TRANSFER BANK

BACKGROUND AND SUMMARY OF THE INVENTION

The present invention relates to a boiler, having a reaction chamber with heat transfer panels or tube banks, formed by several horizontal heat transfer tubes attached one on top of the other, and in which the ends of the heat transfer panels or the tube banks are supported by two opposing walls defining the reaction chamber.

The boiler can be provided with a circulating fluidized bed, in which case solid material and fluidizing gas are introduced into the lower portion of the reaction chamber so that the solid material is fluidized and at least partly transported with the fluidizing gas into the upper portion of the reaction chamber, the particle suspension formed by gas and solid material thus filling the free board area of the reaction chamber. The particle suspension is directed via an opening in the upper portion of the reaction chamber to a particle separator, which separates the solid material from the gas. The particles separated are recycled from the particle separator to the lower portion of the reaction chamber, from which they again flow with the fluidizing gas into the upper portion of the reaction chamber, thus forming a circulating fluidized bed.

Boilers with fluidized beds are especially suitable for burning numerous solid materials, for example coal, peat and waste materials. The heat is recovered with heat surfaces arranged in the boiler and in a convection volume after the boiler. The walls of the boiler can be formed of water walls, and separate tube banks or heat transfer panels can be arranged in the boiler to lower the temperature in the combustion chamber. Separate heat transfer surfaces, supported from the upper portion of the boiler, may be evaporator or superheater surfaces.

The evaporator or superheater surfaces are formed by, for example, welding tubes parallel to each other so that they form a rigid tube bank or panel. In the prior art, the tube banks can be supported vertically from the roof of the reaction chamber or arranged to span the combustion chamber from one wall to the opposing wall, the walls thus supporting the tube banks. The tube banks go through the walls of the reaction chamber and are connected to collector boxes outside the boiler. The tubes are usually rigidly supported by one wall and flexibly, e.g. with a bellows construction, by the opposite wall. The bellows construction absorbs the thermal expansion of the tube bank and simultaneously seals the passages for the tubes through the combustion chamber wall.

As the size of the boilers has increased, it has been necessary to utilize ever longer tube bank constructions. The width of the boilers is often more than 7 to 8 meters, even as much as 15 to 25 meters, and the depth over 5 meters. It has proven difficult to use separate heat transfer banks in such large boilers because the tube banks have to be supported in the middle of the combustion chamber, supports only at the ends of the banks being inadequate.

Large banks are prone to resonance, deformation or bending. The flow of gas, or in a fluidized bed boiler also the flow of solid material, causes pressure fluctuations in the combustion chamber of the boiler and thus resonance and deformation in the tube banks. The liquid or other fluid, such as air, flowing in the tubes can also cause fluctuations in pressure, leading to resonance and deformation of the tube banks. The longer the tube banks are, the more liable they are to vibrate or bend downwardly. The rigidity of the tube panels is not always enough to keep the tube banks straight, so they have to be supported and/or stiffened.

Resonance and bending can cause deterioration of the mechanical strength of the tubes, accelerated wear of the tubes, fatigue of the tube material, and increased corrosion. High temperature and particles flowing in a fluidized bed boiler usually worsen each of these problems.

Tube banks for circulating fluidized bed boilers are often made of "omega" tube banks, in which tubes having a mainly rectangular outer diameter are attached together into plain banks. In fluidized bed boilers the wearing effect of the circulating solid material has been minimized in these vertical, plain banks. Nevertheless, the resonance or bending of the vertical bank will cause a change in the flow of the solid material suspension surrounding the bank, thus increasing turbulence of the stream of solid material adjacent to the bank, causing local wear of the bank.

U.S. Pat. No(s). 4,706,614, 4,753,197, 4,307,777 and 4,331,106 disclose attempts to vertically support tube banks in boilers or the like, either with support means extending from the bottom portion of the combustion chamber or with support means suspended from the roof of the combustion chamber. U.S. Pat. No. 4,955,942 further discloses a tube bank in which the tubes are supported by each other, with plates between the tubes.

When utilizing support means extending from the lower or upper portion of the combustion chamber, the support means also must be cooled or they will not last in the hot and corrosive conditions in the boiler. Local overheating can be fatal to the strength of the support means. Therefore the support means require a cooling circulation of their own and thus increase the cost of the boiler. Uncooled extensions fastened to the support means are liable to burn out quickly.

In addition to the fact that the thick particle suspension in the lower portion of a fluidized bed boiler is very abrading and thus an undesirable surrounding for the support means, all extra structures in the combustion chamber of a fluidized bed boiler should be avoided, as they have a negative effect on the flow of the gas and particle suspensions. Furthermore, such structures intensify the complexity of the combustion chamber.

According to the present invention, a boiler is provided for a fluidized bed reactor with a better supported and more rigid heat transfer bank than in previously known heat transfer bank arrangements. The sideways movement of the heat transfer back has been minimized according to the invention. The boiler has heat transfer banks which are more durable and less prone to wear than in the prior art.

The invention also provides a simple and functional arrangement for supporting and/or stiffening the heat transfer banks in a boiler, especially in a fluidized bed boiler.

In order to achieve the desired results set forth above, a boiler according to the invention has the following components: A plurality of walls defining a reaction chamber. A first heat transfer panel comprising a plurality of elongated first, heat transfer tubes vertically stacked, one atop the other, and extending in a first horizontal dimension. A second heat transfer panel comprising at least one, second, heat transfer tube extending in a second horizontal dimension, essentially perpendicular to said first horizontal dimension. Means for operatively attaching the first elongated heat transfer tubes to two of the reaction chamber walls to support the first elongated tubes extending in the first dimension. Means for operatively attaching the at least one second heat transfer tubes to two of the reaction chamber walls to support the second tubes extending in the second dimension. And, means for connecting the at least one second heat transfer tube to the first heat transfer panel so as to stiffen the first heat transfer panel against sideways movement. Preferably the second panel comprises a plurality of second heat transfer tubes stacked vertically, one a top the other, and including a lowermost and an uppermost tube. The connecting means connects either the lowermost or uppermost tube to the first panel.

According to the invention, the negative effects caused by the bending or resonance of the tube banks are minimized by arranging the heat transfer banks (or even single heat transfer tubes) essentially perpendicularly to each other, thereby supporting or stiffening them in a simple manner. Supported and stiffened tube banks remain vertical and essentially straight and free of vibrations, and both gas and particle streams can flow upwards past the tube banks essentially undisturbed in the direction of the banks, in which case the wearing effect of the streams on the banks is minimized.

In large elongated boilers with an elongated heat transfer tube bank arranged longitudinally through the boiler, two or more perpendicular spaced heat transfer banks in a horizontal plane can be disposed below and/or above and perpendicular to the elongated tube bank to support and stiffen it.

Whether arranged above or below the heat transfer bank, the second perpendicular bank or panel will stiffen and/or support the bank. According to a preferred embodiment of the invention, the first and second tube banks or panels, arranged perpendicularly to each other, are attached to each other, e.g. with retaining lugs, arranged at the crossing points and preventing sideways movements. Thus, e.g., two retaining lugs are welded on the uppermost tube of the transverse second tube bank, at the crossing point of the tube banks, the lugs being spaced from one another a distance approximately equaling the diameter of the tube. A longitudinal tube bank is installed above the transverse tube bank so that the lowermost tube of the longitudinal tube bank passes through the opening defined by the retaining lugs, the lugs thus preventing any sideways movement of the lowermost tube and simultaneously thereby stiffening the whole upper tube bank. Accordingly, retaining lugs can be arranged on the lowermost tube of the second tube bank at the crossing point, and thus any movement of the uppermost tube of the long tube bank, arranged below the second tube bank, can be prevented. Also other heat transfer panels, not made of tubes, can be connected to each other, and supported, in this way.

According to a second embodiment of the invention, two tube banks are fastened to each other with the aid of the individual tubes of the tube banks. At the crossing point, the outermost tube of the tube banks is bent outwardly from the other tubes so that an opening or a "loop" is defined, the size of which is adequate to allow the correspondingly outwardly bent tube of the transverse tube bank to pass through the opening.

Several heat transfer banks can of course be arranged one on top of the other. Perpendicular tube banks can be fit in the gaps between the heat transfer banks as needed, either in every gap or, for example, only in every second gap. A single transverse heat transfer bank can support two long heat transfer banks in a boiler, one arranged above and the other below the transverse bank.

In heat transfer banks or tubes according to the invention the heat transfer fluid is preferably water or steam, but other fluids—such as gas—can also be utilized, depending on the process and temperature.

The arrangements according to the invention are simple and they are readily compatible with existing boilers, and may even be retrofit. They do not need separate external support structures. No openings need to be made in the walls of the boiler for the support structures' lead-through. The support elements according to the invention do not need separate cooling, as the cooling of the heat transfer banks or panels is sufficient. Retaining lugs can be made of such materials and shaped so that they do not overheat or that their heating is not critical.

The invention also comprises a heat exchanger assembly. The heat exchanger assembly comprises: A first heat transfer panel comprising a plurality of first, elongated heat transfer tubes vertically stacked, one atop the other, and extending in a first horizontal dimension. A second heat transfer panel comprising a plurality of second, heat transfer tubes extending in a second horizontal dimension, essentially perpendicular to said first horizontal dimension. And, means for connecting one of the second heat transfer tubes to the first heat transfer panel so as to stiffen the first heat transfer panel against sideways movement, the connecting means comprising a pair of retaining lugs, one attached to each side of the tube of the second panel to which the first panel is connected, and to a tube of the first panel. The retaining lugs may be shaped like bollards, or may be triangularly shaped, and the tubes of the banks may be omega tubes. Any number of heat transfer panels can be provided with alternate panels perpendicularly connected, as described above with respect to the first and second panels.

According to another aspect of the invention another heat exchanger assembly is provided which comprises the following elements: A first heat transfer panel comprising a plurality of first, elongated heat transfer tubes vertically stacked, one atop the other, and extending in a first horizontal dimension. A second heat transfer panel comprising a plurality of second, heat transfer tubes extending in a second horizontal dimension, essentially perpendicular to the first horizontal dimension. And, means for connecting one of the second heat transfer tubes to the first heat transfer panel so as to stiffen the first heat transfer panel against sideways movement, the connecting means comprising means defining bends in one of the tubes of the first panel to define a loop, the uppermost or lowermost tube of the second panel passing through the loop in contact with the bends.

It is the primary object of the present invention to provide a simple yet effective mechanism for supporting panels of heat transfer tubes so as to stiffen them against sideways movement, particularly for use in a boiler, and more particularly a recirculating fluidized bed boiler. This and other objects of the invention will become clear from an inspection of the detailed description of the invention, and from the appended claims.

DETAILED DESCRIPTION OF THE DRAWINGS

Figure 1:
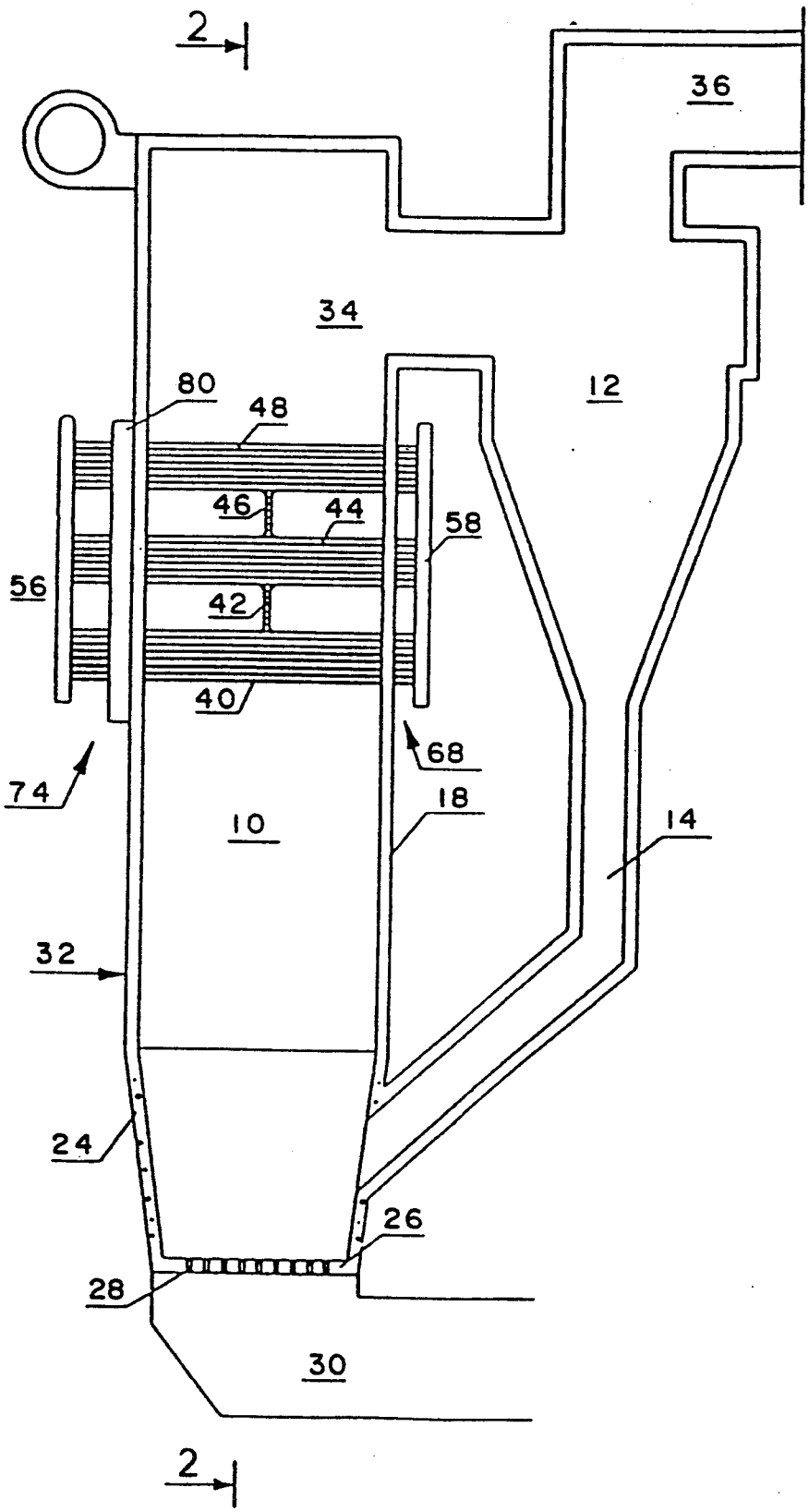
FIG. 1 is a side schematic view, partly in cross-section and partly in elevation, illustrating a circulating fluidized bed reactor boiler according to the invention with heat transfer banks disposed therein.
Figure 2:
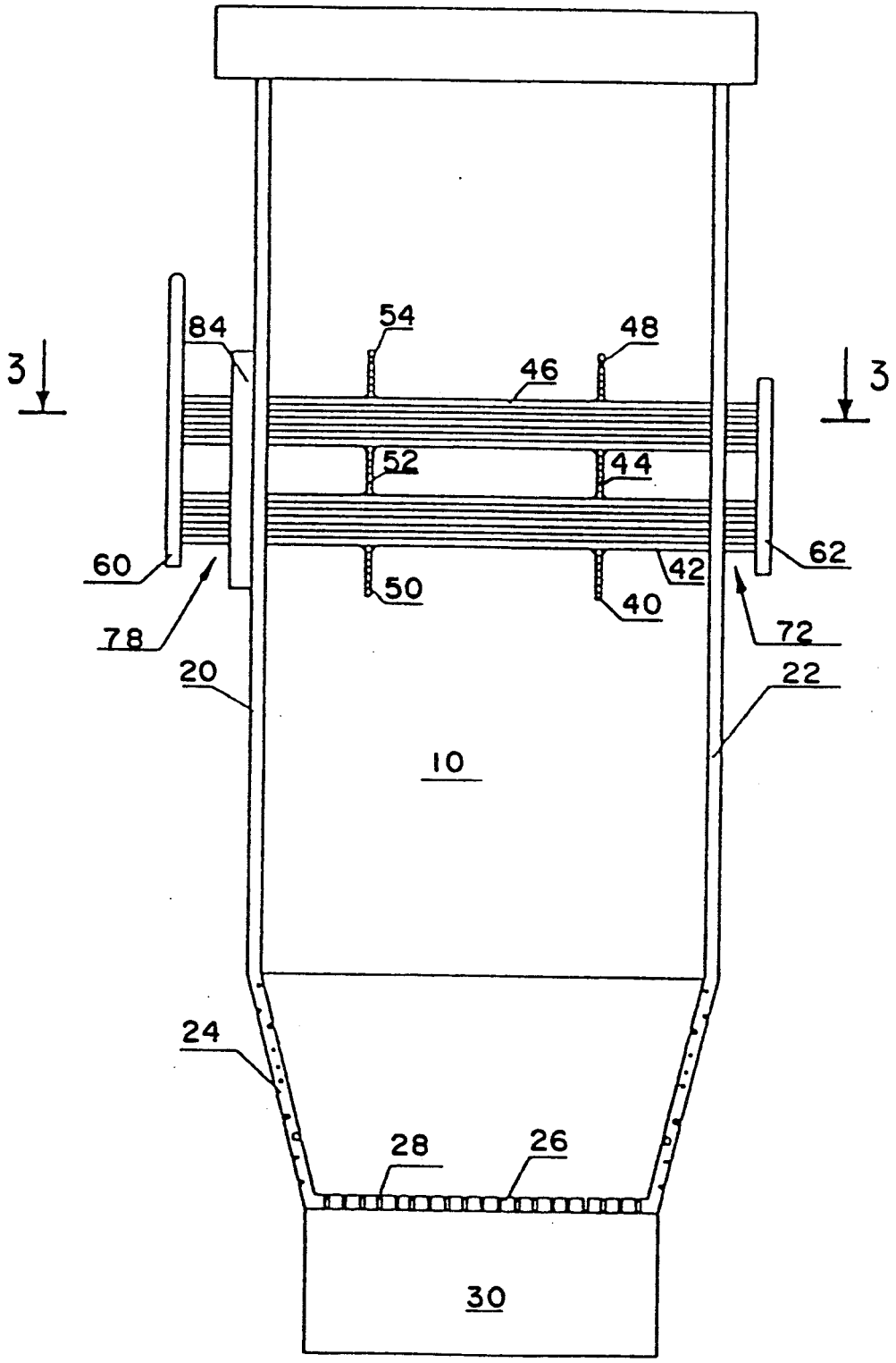
FIG. 2 is a cross-sectional view of the boiler of FIG. 1 taken along lines A—A thereof.
Figure 3:
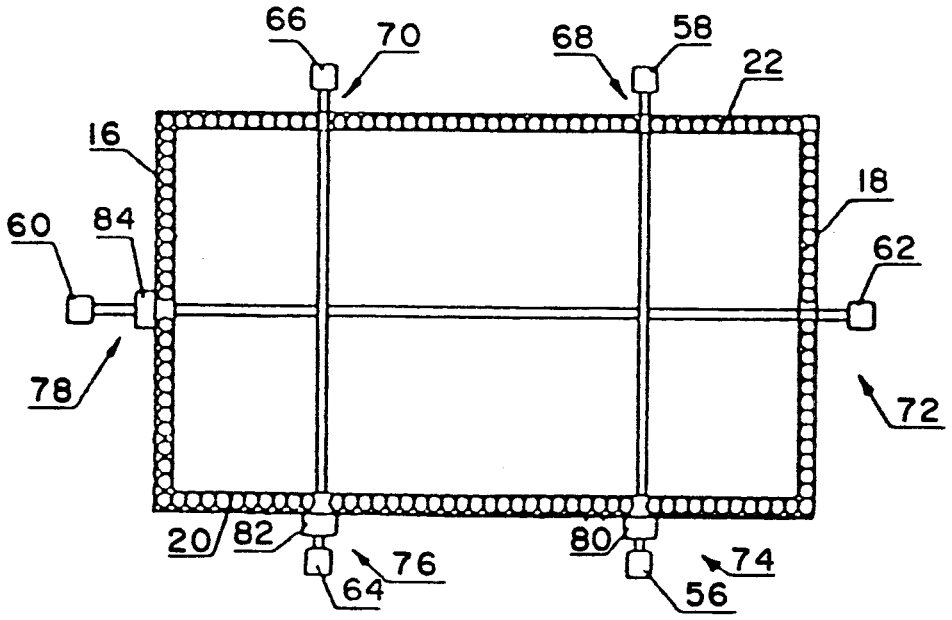
FIG. 3 is a cross-sectional view of the boiler of FIG. 2 taken along lines B—B thereof.

FIGS. 1, 2, and 3 illustrate a circulating fluidized bed reactor according to a preferred embodiment of the invention, comprising a reactor chamber 10, i.e., a combustion chamber or a combustor, a particle separator 12 and a conduit 14 for recycling the particles separated. The combustion chamber has a rectangular cross-section and is formed by side walls 16, 18, 20 and 22 (preferably water walls), of which the long walls 16 and 18 are illustrated in FIG. 1 and the short walls 20 and 22 in FIG. 2. The water walls 16, 18, 20, 22 are preferably formed of vertical water tubes joined together. The walls of the lower portion of the reactor chamber are protected with a protective lining 24.

The bottom of the reactor chamber comprises a nozzle plate 26, the plate 26 being provided with nozzles or openings 28 for introducing fluidizing gas from airbox 30 to maintain a fluidized bed in the reactor chamber 10. Solid material is introduced via inlet 32. Fluidizing gas or air is introduced with a velocity capable of causing some of the fluidized bed material to constantly flow upwards together with the gas into the upper portion of the chamber, and from there via an opening 34 in the upper portion of the chamber 10 to the particle separator 12. The gases are withdrawn from the particle separator 12 via conduit 36.

Heat transfer banks or panels 40, 42, 44, 46, 48, 50, 52 and 54 are arranged in the upper portion of the reactor chamber 10. Some of the banks, i.e. 42 and 46, span the reactor chamber 10 longitudinally from wall 20 to wall 22, forming thus the longest heat transfer banks of the boiler. Other banks, i.e. 40, 44, 48, 50, 52 and 54, span the reactor chamber 10 from one long wall 16 to the other long wall 18, forming thus short, transverse heat transfer banks supporting the long heat transfer banks 42, 46.

Both sets of heat transfer banks are operatively attached to the walls 16, 18, 20, 22 and pass through the walls 16, 18, 20, 22 to headers 56, 58, 60, 62, 64 and 66 disposed outside the walls 16, 18, 20, 22. One end 68, 70, 72 of each tube bank is operatively attached to and supported by the walls 18 and 22 in a fixed manner, whereas the other end 74, 76, 78 is attached to the walls 16 and 20 by bellows constructions 80, 82, 84, which allow thermal expansion of tube banks. The means 68, 74, 80, etc. for attaching the banks 40, etc., to the walls 16, etc., are known per se.

Figure 4A:
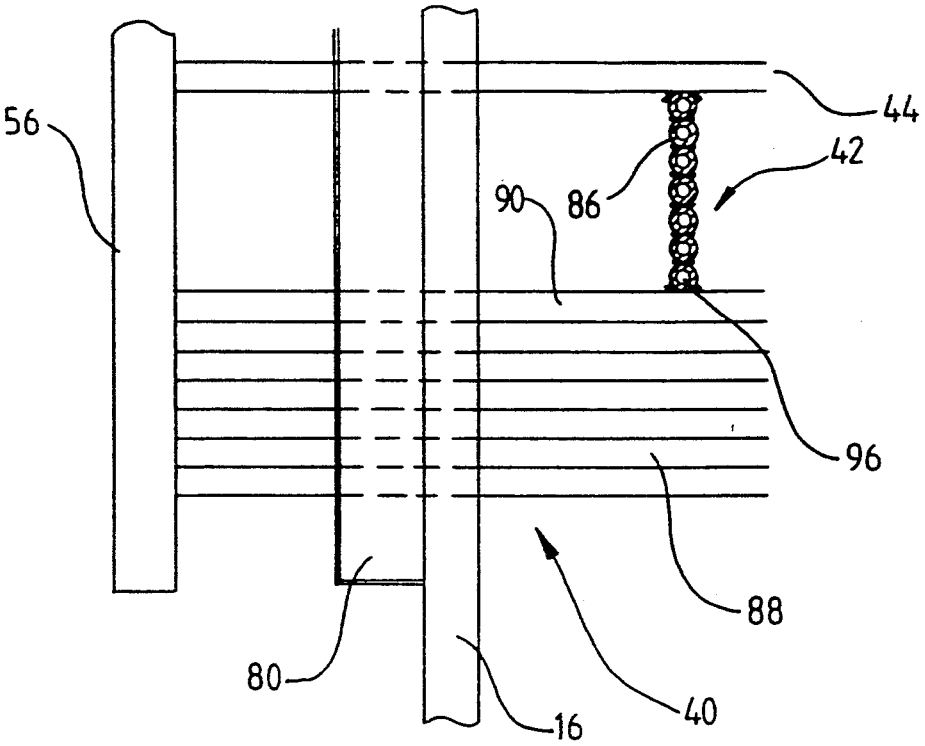
FIG. 4A is a detail view, partly in cross-section and partly in elevation, showing an exemplary manner of interconnecting tubes of adjacent two panels together.
Figure 4B:
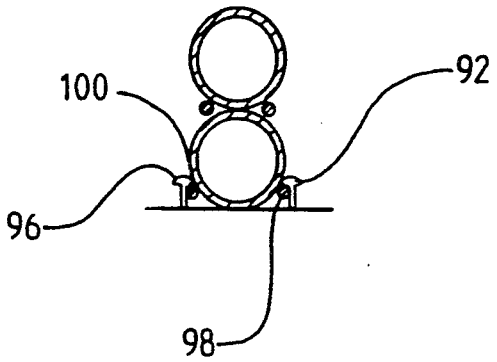
FIG. 4B is an even more greatly enlarged representation of the connection means of FIG. 4A showing the details of the lugs and the connections thereof to the tubes.

FIGS. 4A and 4B are enlargements of the crossing point of the tube banks 40 and 42 of FIG. 1. The tube banks 40, 42 are formed of water tubes 88 and 86, respectively, that have been welded together into vertical banks. Two retaining lugs 92 and 94 have been fastened at the crossing point on the uppermost water tube 90 of the tube bank 40. In the illustrated embodiment, the retaining lugs 92, 94 are shaped like bollards. Two bars or rods 98 and 100 are welded onto the lowermost water tube 96 of the tube bank 42, engaging lugs 92, 94 and supporting the tube 96 between the retaining lugs 92, 94. Thus any sideways movement of the upper water tube bank 42 is prevented and the bank is kept vertical and unbent (straight).

Figure 5:
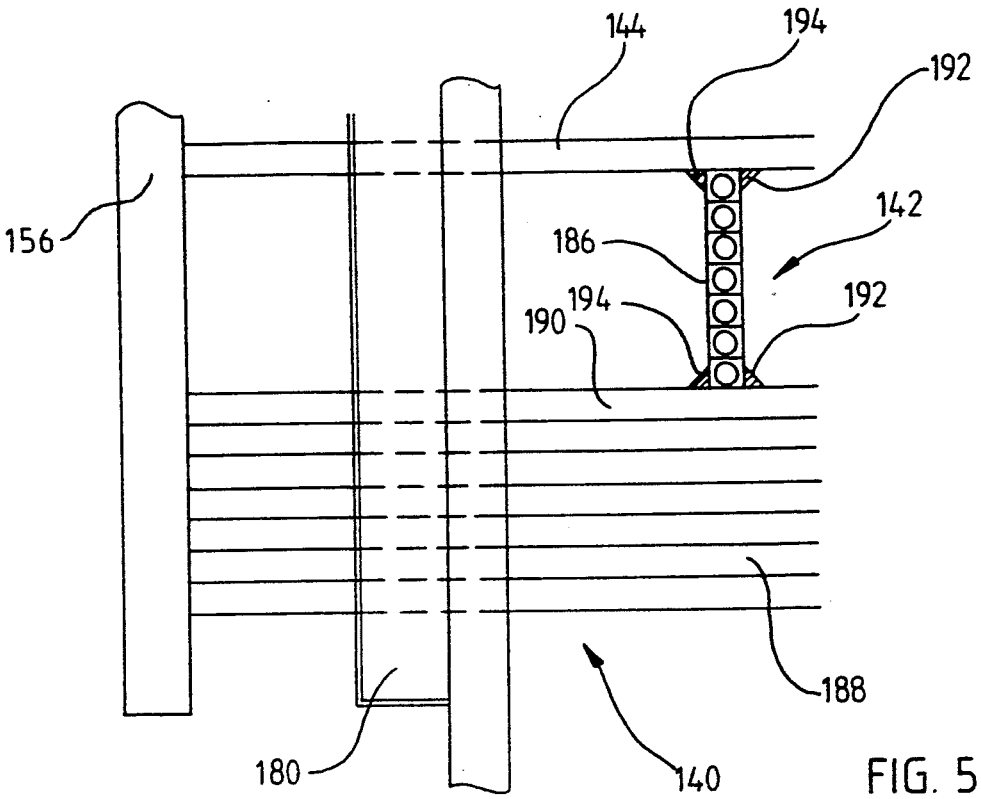
FIG. 5 is a view like that of FIG. 4A showing a second embodiment of connecting means according to the invention.

A second embodiment of the connecting means for connecting the heat transfer banks together is illustrated in FIG. 5. In the embodiment of FIG. 5 components comparable to those of the FIG. 4A embodiment are illustrated by the same reference numeral only preceded by a "1".

The heat transfer banks can, as shown in FIG. 5, be made of omega tubes 186 and 188, in which case the outer surfaces of the water tube banks 140 and 142 are almost completely plain. In this case the cross-section of the retaining lugs 192 and 194 can be polygonal, e.g. triangular, as is illustrated in FIG. 5. The lugs 192, 194 are welded to the tubes 190, 144. Other kinds of lamellar walls can also be correspondingly supported.

Figure 6:
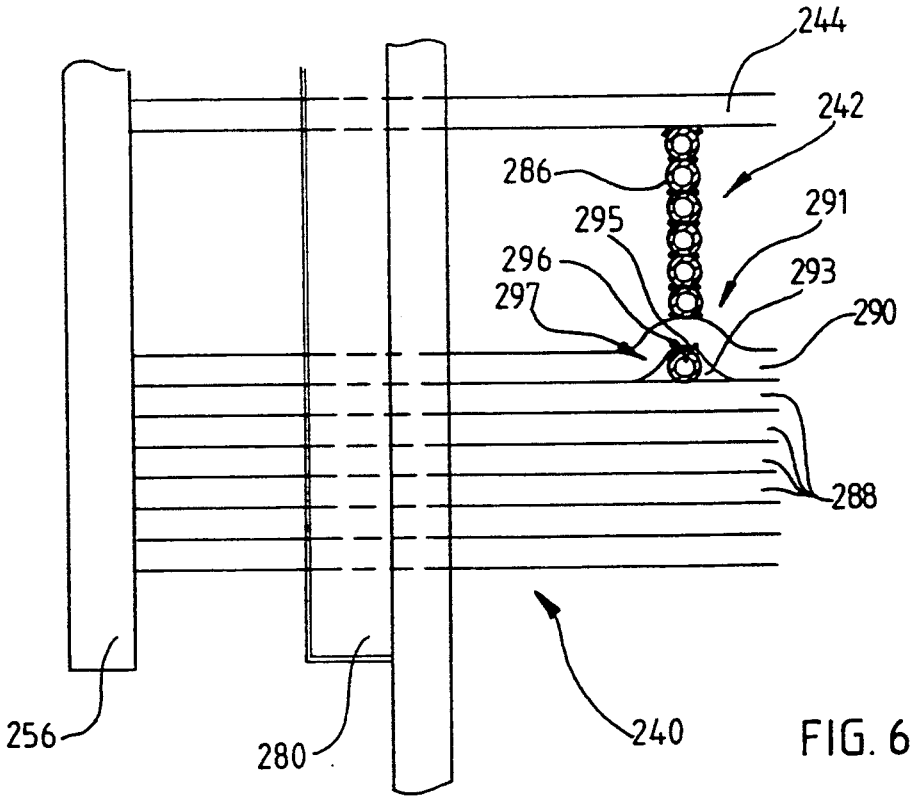
FIG. 6 is a view like that of FIG. 4A only showing a third embodiment of connecting means according to the invention.

In the third embodiment of connecting means illustrated in FIG. 6, components comparable to those in the FIG. 4A embodiment are shown by the same two digit reference numeral only preceded by a "2".

In the FIG. 6 embodiment, the outermost water tubes 290 and 296 of two water tube banks 240 and 242 have been bent to form bends 291 and 297 so that openings 293 and 295 are defined between the outermost tubes 290, 296 and other tubes 286 and 288 of the tube banks 240, 242, so that one outermost tube 290 can be arranged to go through the opening 295 formed by the other outermost tube 296, and engage the bends 291, 297. The tube panel 242 is thus supported at its lower portion to tube panel 240 and cannot move. This arrangement according to the invention is relatively easily realizable during the installation of the tube banks.

Of course as illustrated in FIGS. 1 and 2 any number of tube banks or panels may be connected together, including a plurality of perpendicular banks connected along the length of particularly long banks (as illustrated in FIG. 2), and the invention may be readily retrofit into existing installations.

While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A boiler comprising:

a plurality of walls defining a reaction chamber;

a first heat transfer panel comprising a plurality of elongated first, heat transfer tubes vertically stacked, one atop the other, and extending in a first horizontal dimension;

a second heat transfer panel comprising at least one, second, heat transfer tube extending in a second horizontal dimension, essentially perpendicular to said first horizontal dimension;

means for operatively attaching said first elongated heat transfer tubes to two of said reaction chamber walls to support said first elongated tubes extending in said first dimension;

means for operatively attaching said at least one second heat transfer tubes to two of said reaction chamber walls to support said second tubes extending in said second dimension; and means for connecting said at least one second heat transfer tube to said first heat transfer panel so as to stiffen said first heat transfer panel against sideways movement.

2. A boiler as recited in claim 1 wherein said second panel comprises a plurality of second heat transfer tubes stacked vertically, one atop the other, and including a lowermost and an uppermost tube; and wherein said connecting means connects either said lowermost or said uppermost tube to said first panel.

3. A boiler as recited in claim 2 wherein said connecting means comprises a pair of retaining lugs, one attached to each side of the tube of said second panel to which said first panel is connected, and to an elongated tube of said first panel.

4. A boiler as recited in claim 3 wherein said retaining lugs are shaped like bollards.

5. A boiler as recited in claim 4 wherein said connecting means further comprises a bar or rod welded to each side of the tube of said second panel to which said first panel is connected, and engaging one of said retaining lugs.

6. A boiler as recited in claim 3 wherein said retaining lugs are triangularly shaped.

7. A boiler as recited in claim 6 wherein said tubes of said first and second banks are omega tubes.

8. A boiler as recited in claim 2 wherein said connecting means comprises means defining bends in one of said tubes of said first panel to define a loop, the uppermost or lowermost tube of said second panel passing through said loop in contact with said bends.

9. A boiler as recited in claim 2 further comprising third and fourth heat transfer panels each comprising a plurality of horizontally extending, vertically stacked, heat transfer tubes, said third panel tubes extending parallel to said first panel tubes, and said fourth panel tubes extending parallel to said second panel tubes; and means for connecting said third panel to said second heat transfer panel, and said fourth panel to said third panel, so as to stiffen the heat transfer tubes of said second and third panels against sideways movement.

10. A boiler as recited in claim 1 wherein said means for operatively attaching said first and second heat transfer tube panels to said reaction chamber walls comprise bellows means, to allow for thermal expansion, at one wall for each of said panels.

11. A boiler as recited in claim 1 further comprising a particle separator connected to said reaction chamber, a conduit for recycling particles separated by said separator to said reaction chamber, and means for fluidizing material at the bottom of said reaction chamber, so that said boiler comprises a recirculating fluidized bed reactor boiler.

12. A heat exchanger assembly comprising:

a first heat transfer panel comprising a plurality of first, elongated heat transfer tubes vertically stacked, one atop the other, and extending in a first horizontal dimension;

a second heat transfer panel comprising a plurality of second, heat transfer tubes extending in a second horizontal dimension, essentially perpendicular to said first horizontal dimension; and means for connecting one of said second heat transfer tubes to said first heat transfer panel so as to stiffen said first heat transfer panel against sideways movement, said connecting means comprising a pair of retaining lugs, one attached to each side of the tube of said second panel to which said first panel is connected, and to a tube of said first panel.

13. An assembly as recited in claim 12 wherein said retaining lugs are shaped like bollards.

14. An assembly as recited in claim 13 wherein said connecting means further comprises a bar or rod welded to each side of the tube of said second panel to which said first panel is connected, and engaging one of said retaining lugs.

15. An assembly as recited in claim 12 wherein said retaining lugs are triangularly shaped.

16. An assembly as recited in claim 15 wherein said tubes of said first and second banks are omega tubes.

17. An assembly as recited in claim 12 further comprising third and fourth heat transfer panels each comprising a plurality of horizontally extending, vertically stacked, heat transfer tubes, said third panel tubes extending parallel to said first panel tubes, and said fourth panel tubes extending parallel to said second panel tubes; and means for connecting said third panel to said second heat transfer panel, and said fourth panel to said third panel, so as to stiffen the heat transfer tubes of said second and third panels against sideways movement.

18. A heat exchanger assembly comprising:

a first heat transfer panel comprising a plurality of first, elongated heat transfer tubes vertically stacked, one atop the other, and extending in a first horizontal dimension;

a second heat transfer panel comprising a plurality of second, heat transfer tubes extending in a second horizontal dimension, essentially perpendicular to said first horizontal dimension; and means for connecting one of said second heat transfer tubes to said first heat transfer panel so as to stiffen said first heat transfer panel against sideways movement, said connecting means comprising means defining bends in one of said tubes of said first panel to define a loop, the uppermost or lowermost tube of said second panel passing through said loop in contact with said bends.

19. An assembly as recited in claim 18 further comprising third and fourth heat transfer panels each comprising a plurality of horizontally extending, vertically stacked, heat transfer tubes, said third panel tubes extending parallel to said first panel tubes, and said fourth panel tubes extending parallel to said second panel tubes; and means for connecting said third panel to said second heat transfer panel, and said fourth panel to said third panel, so as to stiffen the heat transfer tubes of said second and third panels against sideways movement.

20. An assembly as recited in claim 19 wherein said means for connecting said third panel to said second panel, and said fourth panel to said third panel, comprise means defining bends in tubes to define a loop, and a tube passing through said loop in contact with said bends, as in said means for connecting said first and second heat transfer panels together.

* * * * *